US005401379A

United States Patent [19]

Mazzochi

[11] Patent Number: 5,401,379

[45] Date of Patent: Mar. 28, 1995

[54] CHROME PLATING PROCESS

[76] Inventor: James L. Mazzochi, 1400 W. 31st Pl., Chicago, Ill. 60608

[21] Appl. No.: 33,891

[22] Filed: Mar. 19, 1993

[51] Int. Cl.[6] ..... C25D 5/12; C25D 5/34; C25D 5/48

[52] U.S. Cl. ..... 205/99; 205/100; 205/101; 205/271; 205/283

[58] Field of Search ..... 205/271, 283, 99, 100, 205/101

[56] References Cited

U.S. PATENT DOCUMENTS

| | | | |
|---|---|---|---|
| 3,637,467 | 1/1972 | Spatz | 204/14 R |
| 3,661,732 | 5/1972 | Withrow | 204/51 |
| 3,681,210 | 8/1972 | Zievers et al. | 204/35 R |
| 3,681,212 | 8/1972 | McKissick | 204/51 |
| 3,761,381 | 9/1973 | Yagishita | 204/238 |
| 3,973,987 | 8/1976 | Hewitt et al. | 134/12 |
| 3,979,220 | 9/1976 | Ishiyama et al. | 134/10 |
| 4,006,072 | 2/1977 | Takayasu | 204/238 |
| 4,171,255 | 10/1979 | Tuznik et al. | 204/238 |
| 4,197,167 | 4/1980 | Wright, Jr. | 204/40 |
| 4,561,956 | 12/1985 | Antonelli | 204/232 |
| 4,592,819 | 6/1986 | Suzuki et al. | 204/203 |
| 4,746,414 | 5/1988 | Carpenter et al. | 204/240 |
| 4,778,572 | 10/1988 | Brown | 205/100 |
| 4,781,806 | 11/1988 | Tenace et al. | 204/149 |
| 4,952,290 | 8/1990 | Carnarius et al. | 204/149 |

FOREIGN PATENT DOCUMENTS 457930 11/1991 European Pat. Off. .

OTHER PUBLICATIONS

Pinkerton, Rinsing, Electroplating Engineering Handbook, 2nd ed., 1962 (no month), pp. 705–715.

*Primary Examiner*—John Niebling
*Assistant Examiner*—Edna Wong
*Attorney, Agent, or Firm*—Thompson, Hine & Flory

[57] ABSTRACT

This is to a process for chromium plating metal articles spray rinsing the metal article after it has been cleaned, acid treated, nickel plated, and chromium plated over rinse tanks which are empty except for the rinse collected therein. The rinse water is recirculated to the respective treating tanks as needed.

26 Claims, 1 Drawing Sheet

CHROME PLATING PROCESS

The present invention relates to a plating metal and more particularly relates to a process of chrome plating metal while eliminating toxic chrome waste water.

BACKGROUND OF THE INVENTION

The chrome plating industry is slowly being eliminated due to the toxic waste created by the chromium chemicals used, the pollution they create to the sewage system and the large amount of water the system uses. There is a need to provide a process where water is conserved and there is no pollution of the public sewage system.

U.S. Pat. Nos. 3,681,210; 4,781,806 and 4,952,290 teach chrome plating processes wherein the metal article is passed through an electroplating procedure wherein many of the materials are recirculated to conserve the materials and to reduce the amount of waste product. However, the U.S. Pat. No. 4,952,290 uses a closed system which requires large amounts of water and equipment because it uses overflow solutions, collecting tanks, and storage tanks. U.S. Pat. No. 4,781,806 uses a plurality of treating tanks and recirculation equipment. However, this patent increases mixing efficiency by providing air agitation in the rinse tank along with overhead rinse sprays. This patent, however, has a process which does produce waste overflow which must be further treated to provide a sludge cake that is disposed of in an appropriate land fill.

U.S. Pat. No. 3,681,210 shows a multi-step process for electroplating metal parts with chromium which is directed to recovering water used to rinse the workpieces. This patent requires the rinse water to be treated with an exchange resin. This patent does not discuss using a completely closed system.

Further, all of the above patents provide chromium electroplating systems that use a plurality of rinse tanks that require the article to be dipped into the rinsing solution.

The process of chrome plating is generally well known. Generally, to chrome plate a metal article, the metal article is cleaned usually with a caustic soda solution to degrease the article. The metal article is then subjected to an acid pickling solution, electroplated with nickel and then finally electroplated with chromium.

Therefore, it is an object of the present invention to provide an economical process for chrome plating metal parts without creating any public sewage waste water.

SUMMARY OF THE INVENTION

My invention relates to using the generally accepted steps of plating a metal article with variations that improve the efficiency of the plating process. First, I electroclean the metal article. The cleaned metal article is then placed over a substantially empty rinse tank and sprayed with the water to remove any cleaning solution residue on the metal article. The cleaned and rinsed metal article is then delivered to a pretreatment tank.

The pretreatment tank contains an acid pickling solution. The cleaned and rinsed metal article is then dipped into the acid pickling solution. The acid treated metal article is then removed from the acid pickling tank and placed over a substantially empty rinse tank. The metal article is then placed in a pre-metal electroplating solution wherein it is electroplated with the pre-metal such as nickel. After being electroplated with the pre-metal, the metal article is spray rinsed over two tanks which are sequential to each other. Also, these two tanks are substantially empty.

In the preferred embodiment, the process of the invention is incorporated into a chrome plating process, in which case from the pre-metal rinsing, the pre-metal coated metal article is electroplated with chromium in a chromium electroplating solution. After being chromium coated, the chromed metal article is spray rinsed over two substantially empty tanks. In the final step of the process, the chromed metal article is removed from its holding bar. The hooks and the holding bar that hold the metal article are spray rinsed over a substantially empty tank. All of the rinses are recirculated. Because of the recirculation and evaporation which takes place, public sewage waste is eliminated. The cleaning solution rinse water collected in the cleaning rinse tank is recirculated directly to the cleaning tank. The rinse water collected in the acid rinse tank is generally first evaporated and then recirculated to the acid tank. The rinse water collected in the pre-metal rinse tanks are generally first filtered and then recirculated to the pre-metal tank. The rinse water in the chromium rinse tanks are recirculated to the chromium tank.

The water used in our process is preferably deionized prior to being used to rinse or dilute the solutions in one of the tanks.

The accompanying drawings and the detailed description of our invention will aid in the understanding of my invention and the aforementioned objects and advantages. Other objects and advantages may become readily apparent.

DETAILED DESCRIPTION OF A PREFERRED EMBODIMENT

Figure 1:
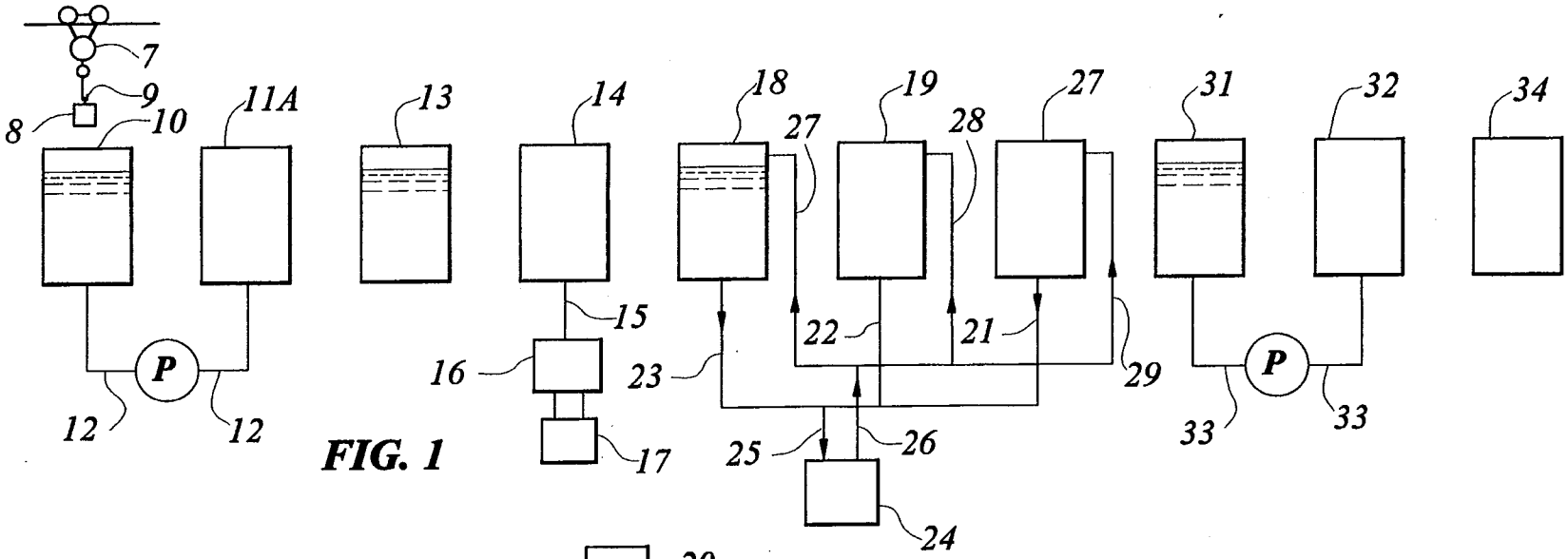
FIG. 1 is a schematic representation of my electroplating process.

Referring to FIG. 1, a metal article 8, such as a bumper (not shown) is placed on hooks 9 or other suitable holders which are usually operated by an overhead winch 7. The metal article is brought over a standard first electrocleaning tank 10. The metal article and tank are electrically connected to an electrical rectifier (not shown). I use a 2000 amp rectifier for this purpose. The tank 10 is substantially filled with a typical caustic soda cleaning solution 11. The cleaning solution used in tank 10 is prepared by mixing caustic soda with deionized water. Generally, I mix 450 lbs. of caustic soda with 800 gal. of deionized water. The tank 10 has a heater (not shown) connected thereto. The heater is used to heat the electrocleaning solution to a temperature of from about 160° F. to about 200° F. and preferably the thermostat for the heater is set at about 180° F. The metal article is immersed in the electrocleaning solution and remains in the cleaning solution from about 2 to about 5 minutes. The article is then removed from the cleaning solution and lightly sprayed and washed manually to remove any loose or clinging material (grease, etc.). The metal article is once again placed in the electrocleaning tank solution for from about 1 to about 3 minutes.

The cleaned metal article is then removed from the cleaning solution, placed over a substantially empty rinse tank 11A. The cleaned article is then manually sprayed with water, which preferably has been deionized. When approximately 6 inches of water accumulates in tank 11A, the water is recirculated via line 12 to the tank 10. Because the cleaner solution tank 10 is heated, there is constant evaporation of water. The water evaporated from tank 10 is generally replaced by the water circulated by line 12 which also contains some caustic soda which was rinsed off of the article.

Also, tank 11A may have a heater coil in the bottom thereof to evaporate the cleaning solution. This is usually done periodically. The residue of the evaporation is an ash-like residue. When new cleaning solution is required, the cleaning solution in tank 10 is pumped to tank 11A and the old cleaning solution evaporated and the ash-like residue is collected.

The cleaned and rinsed article is then brought over an acid pickling tank 13. The tank 13 has therein a sulfuric acid solution. The solution is prepared by mixing 6.5 gallons of LT Electrol with approximately 800 gal. of deionized water. The article is immersed in the sulfuric acid solution for about 3 to 5 minutes. This step is necessary to dissolve any embedded caustic soda cleaner residue that remained on the metal article.

The acid pickled metal article is removed from tank 13 and brought over substantially empty acid rinse tank 14. The acid pickled metal article is manually sprayed with water which has preferably been deionized. When more than 6 inches of the acid rinse water has been collected in the tank 14, the acid rinse water is pumped to storage container 16 via line 15. From the container 16 it is circulated through an air evaporator 17 where the acid rinse water is concentrated and stored in storage container 16 to be circulated to tank 13 as desired.

Figure 2:
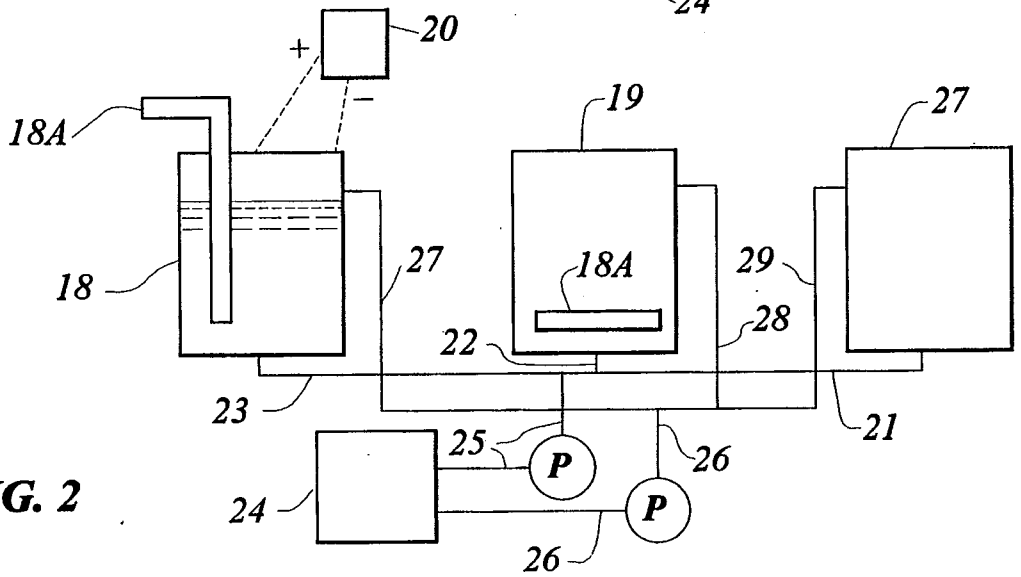
FIG. 2 is a schematic representation of the nickel treatment of my electroplating process.

After acid rinsing, the rinsed acid treated metal article is brought to a nickel electroplating tank 18 (See FIG. 2). The tank 18 has therein an appropriate anode (not shown). The metal article and the anode are connected to a second rectifier 20. This is a 3000 amp rectifier. The rectifier will supply the current necessary to electroplate the various articles with nickel. The tank 18 also has connected thereto a titanium heater 18A to heat the nickel electroplating solution to between about 125° to about 160° F. Preferably the heater thermostat is set at about 140° F. The typical tank contains about 800+ gallons of nickel plating solution. The nickel plating solution generally has therein nickel, nickel sulfate, nickel chloride, boric acid and other ingredients. The metal article remains immersed in the nickel solution for about 45 to about 60 minutes. The nickel plated article is removed from tank 18 and placed over substantially empty tank 19. Tank 19 has a titanium heater therein that heats and aids in the evaporation of water from any solution in tank 19. The nickel plated article is manually spray rinsed with water, preferably deionized water over tank 19. The nickel rinse water collects in the bottom of tank 19 and the water is evaporated by the heater to concentrate the nickel rinse water collected. Preferably, before the nickel solution is fed to the tank 18, it is filtered by filter 24. The solution from tank 19 is fed to the filter 24 via lines 22 and 25. The nickel from tank 18 is also recirculated through filter 24 via lines 23 and 25. After having the first spray rinse over tank 19, the nickel plated article is placed over substantially empty tank 27 and has a second water spray rinse, preferably deionized water, spray rinse. The second spray rinse water is collected in tank 27 and recirculated as necessary via lines 21 and 25 to the filter 24 and tank 18. As shown in FIG. 2, the filtered nickel rinse and solution can be fed back to rinse tanks 19 and 27 via lines 26, 28 and 29. For storage intake it is necessary for it to be fed into tank 19.

My process has substantially reduced the large volumes of water used by previous constant running rinse tanks generally used in electroplating processes, has reduced the amount of chemicals needed for the electroplate process and has also eliminated waste dumpage into the local sewage system.

The nickel plated article, after being rinsed is brought to the chrome electroplating tank 31 (see FIG. 1). The chrome electroplating tank has a titanium heater to heat the chrome plating solution to a temperature of from about 100° F. to about 120° F. The heater thermostat is generally maintained at a temperature of about 112° F. The tank generally holds about 800+ gallons of chrome plating solution. The solution contains hexavalent chromium ions, sulfate and the normal catalyst.

Within the tank is an anode which is connected to a third rectifier. The articles are also connected to the third rectifier. This rectifier is a 3000 amp rectifier. The nickel coated article remains in the chrome plating solution with the rectifier activated for about 3 to 5 minutes. Then the chrome plated article is placed over a substantially empty chrome rinse tank 32. The chrome plated article is then sprayed with water, preferably deionized water to rinse off all the excess chromium.

The tank 32 has a recirculation system 33 that recirculates the collected chrome rinse solution to the chrome plating tank 31. Normally, at this stage, the chrome plated article, the copper work bar and article hooks would be placed on a machine table and any excess chrome solution from the bar and hooks would fall onto the floor. In the present invention, the rinsed article is placed on a racking table, the hooks and work bar are spray rinsed with water, preferably deionized water, to remove any chromium solution from the bar and hooks. The diluted chromium rinse water is collected in tank 34 and returned to the chromium tank 32 as needed.

Water in the chromium solution, the nickel solution, the nickel rinse solution, the caustic soda solution and the sulfuric acid solution is constantly evaporating. The water and concentration is maintained by the recirculation set forth above and when needed by fresh water. These solutions are periodically monitored to be sure that their concentrations are within acceptable limits. If new material need be added, it is. However, by using spray rinsing and substantially empty rinse tanks, large amounts of water are saved over the generally used circulating rinse tanks. Also, our system is substantially free of toxic waste. I have closed my city sewage drains in that they are not needed.

Further, the recycling used in my process provides a substantial cost savings in the amount of new nickel and chrome solutions which have to be used.

I claim:

1. A plating process comprising the steps of:

cleaning and acid treating a metal article;

electroplating the acid treated metal article in an electroplating solution;

spray rinsing the plated article with water over a rinse tank to provide a rinsed plated article;

collecting spray rinse water from said spray rinsing step in said rinse tank and heating said collected water in said rinse tank to a temperature sufficient to cause evaporation and concentration of said collected rinse water;

transferring said collected and concentrated spray rinse water from said rinse tank to said electroplating solution;

immersing the rinsed plated article in a metal plating solution;

electroplating the immersed plated article;

removing a plated article from the plating solution;

spray rinsing the plated article with water over a second rinse tank to provide a completed plated article; and transferring at least a portion of the spray rinse water collected in the second rinse tank from said second rinse tank to said plating solution.

2. A metal plating process comprising the steps of:

immersing an article in a cleaning solution;

spray rinsing the article;

collecting rinse water from said rinsing step and transferring said collected rinse water to the cleaning solution;

immersing the rinsed article in a pretreatment tank;

spray rinsing the article;

immersing the article in a pre-metal electroplating solution;

spray rinsing the article over a rinse tank;

collecting and heating rinse water in said rinse tank to a temperature sufficient to cause evaporation and thereby concentrating said rinse water;

transferring remaining collected, heated, and concentrated rinse water from said rinse tank to the pre-metal electroplating solution;

immersing said article in a plating solution;

spray rinsing the article; and collecting rinse water in a second rinse tank and transferring said collected rinse water to the plating solution.

3. The process of claim 1 further comprising:

after cleaning and acid treating the article, spray rinsing the article with water over a rinse tank;

collecting rinse water in the rinse tank; and concentrating said rinse water by evaporation.

4. A method for plating an article comprising the steps of:

immersing said article in a plating tank of electroplating solution, plating said article and removing said plated article from said plating tank;

spray rinsing said plated article over a rinse tank and collecting rinse solution from said plated article in said rinse tank;

heating said rinse solution in said rinse tank to evaporate and concentrate said solution; and conveying said concentrated solution from said rinse tank to said plating tank, whereby a need for wastewater discharge is eliminated and a need for continual addition of plating solution to said plating tank is reduced.

5. The method of claim 4 wherein said rinse solution is heated to a level whereby evaporation occurs at such a rate that the addition of said concentrated solution to said plating tank substantially equals the loss of electroplating solution from said plating tank by evaporation and drag out by removal of said plated article therefrom.

6. The method of claim 4 further comprising the step of filtering said concentrated solution prior to said conveying step.

7. The method of claim 6 further comprising the step of recirculating said filtered concentrated solution to said plating tank.

8. The method of claim 4 further comprising the steps of spray rinsing said article over a second rinse tank; collecting rinse solution from said article in said second rinse tank; and conveying said rinse solution from said second rinse tank to said plating tank.

9. The method of claim 8 further comprising the step of filtering said rinse solution prior to placing said rinse solution in said plating tank.

10. A method for plating an article comprising the steps of:

immersing said article in an electroclean tank of cleaning solution, cleaning said article and removing said cleaned article from said electroclean tank;

spray rinsing said cleaned article over a rinse tank and collecting rinse solution from said cleaned article in said rinse tank;

heating said rinse solution in said rinse tank to evaporate and concentrate said solution; and conveying said concentrated solution from said rinse tank to said electroclean tank, whereby a need for wastewater discharge is eliminated and a need for continual addition of cleaning solution to said electroclean tank is reduced.

11. A method for plating an article comprising the steps of:

immersing said article in a pickling tank of acid solution, pickling said article and removing said pickled article from said pickling tank;

spray rinsing said pickled article over a rinse tank and collecting rinse solution from said pickled article in said rinse tank;

evaporating said rinse solution in an air evaporator at a location separate from said pickling step without heating to concentrate said solution by evaporating water vapor to atmosphere.

12. The method of claim 11 wherein said evaporating step includes the step of conveying said rinse solution to evaporator means for partially evaporating and concentrating said rinse solution.

13. The method of claim 12 wherein said evaporator means includes storage container means, and said evaporating step includes the step of receiving concentrated rinse solution in said storage container means.

14. A method for plating an article comprising the steps of:

immersing said article in an electroclean tank of cleaning solution, cleaning said article and removing said cleaned article from said electroclean tank;

spray rinsing said cleaned article over a first rinse tank and collecting rinse solution from said cleaned article in said first rinse tank;

heating said rinse solution in said first rinse tank to evaporate and concentrate said solution; and conveying said concentrated solution from said first rinse tank to said electroclean tank, whereby a need for wastewater discharge is eliminated and a need for continual addition of cleaning solution to said electroclean tank is reduced;

immersing said rinsed, cleaned article in a pickling tank of acid solution, pickling said rinsed, cleaned article and removing said pickled article from said pickling tank;

spray rinsing said pickled article over a second rinse tank and collecting rinse solution from said pickled article in said second rinse tank;

evaporating said rinse solution from said second rinse tank to concentrate said solution at a location separate from said pickling step, whereby a need for wastewater discharge is eliminated;

immersing said article in a plating tank of electroplating solution, plating said article and removing said plated article from said plating tank;

spray rinsing said plated article over a third rinse tank and collecting rinse solution from said plated article in said third rinse tank;

heating said rinse solution in said third rinse tank to evaporate and concentrate said solution; and conveying said concentrated solution from said third rinse tank to said plating tank, whereby a need for wastewater discharge is eliminated and a need for continual addition of plating solution to said plating tank is reduced.

15. The method of claim 14 wherein said evaporating step includes the step of conveying said rinse solution from said second rinse tank to evaporator means for partially evaporating and concentrating said rinse solution at said location separate from said pickling step.

16. The method of claim 15 wherein said evaporator means comprises an air evaporator.

17. The method of claim 16 wherein said evaporator means includes storage container means, and said evaporating step includes the step of receiving concentrated rinse solution in storage container means and conveying said rinse solution from said storage container means to said pickling tank.

18. The method of claim 14 wherein said rinse solution from said third rinse tank is heated at said location separate from said plating step to a level whereby evaporation occurs at such a rate that the addition of said concentrated solution to said plating tank substantially equals the loss of electroplating solution from said plating tank by evaporation and dragout by removal of said plated article therefrom.

19. The method of claim 14 further comprising the step of filtering said concentrated solution in said third rinse tank at said location separate from said plating step prior to said conveying step.

20. The method of claim 19 further comprising the step of recirculating said filtered concentrated solution to said plating tank.

21. The method of claim 14 further comprising the steps of spray rinsing said plated article over a fourth rinse tank; collecting rinse solution from said plated article in said fourth rinse tank at a location separate from said plating step; and conveying said rinse solution from said fourth rinse tank to said plating tank.

22. The method of claim 21 further comprising the step of filtering said rinse solution prior to placing said rinse solution in said plating tank.

23. A method of chemically treating an article comprising the steps of:

providing a working tank having a treatment solution of a first concentration;

immersing said article in said treatment solution in said working tank;

removing said article from said working tank and spray rinsing said article with a liquid to remove dragout treatment solution therefrom;

collecting and heating said liquid in a rinse tank to evaporate said liquid and concentrate said treatment solution in said liquid; and conveying said liquid with said concentrated treatment solution from said rinse tank to said working tank, thereby eliminating a need for disposing of waste liquid.

24. A method of chemically treating an article comprising the steps of:

providing a working tank having a treatment solution of a first concentration;

immersing said article in said treatment solution in said working tank;

removing said article from said working tank;

spray rinsing said article to remove dragout treatment solution therefrom;

collecting and heating said collected spray rinse and said removed dragout treatment solution in an evaporation tank having a heater, thereby evaporating and concentrating said spray rinse and removed dragout treatment solution; and transferring said evaporated and concentrated spray rinse and removed dragout treatment solution from said evaporation tank to said working tank, thereby eliminating a need for disposing of waste water.

25. The plating process of claim 1 wherein said spray rinse water from said second rinse tank is heated in said rinse tank to a temperature sufficient to cause evaporation and concentration of said collected rinse water.

26. The process of claim 2 wherein said rinse water from said second rinse tank is heated in said rinse tank to a temperature sufficient to cause evaporation and concentration of said collected rinse water before said step of transferring to the plating solution.

* * * * *